US006371084B1

(12) United States Patent
Betz

(10) Patent No.: US 6,371,084 B1
(45) Date of Patent: Apr. 16, 2002

(54) FUEL INJECTION VALVE FOR HIGH-PRESSURE INJECTION WITH IMPROVED CONTROL OF FUEL DELIVERY

(75) Inventor: Lorenz Betz, Burgebrach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/486,000

(22) PCT Filed: Jun. 5, 1999

(86) PCT No.: PCT/DE99/01649

§ 371 Date: May 15, 2000

§ 102(e) Date: May 15, 2000

(87) PCT Pub. No.: WO99/66191

PCT Pub. Date: Dec. 23, 1999

(30) Foreign Application Priority Data

Jun. 18, 1998 (DE) ..... 198 27 267

(51) Int. Cl.[7] ..... F02M 37/04
(52) U.S. Cl. ..... 123/467; 123/496
(58) Field of Search ..... 123/467, 496, 123/500, 501, 446; 251/30.02

(56) References Cited

U.S. PATENT DOCUMENTS

| | | | | | |
|---|---|---|---|---|---|
| 5,012,786 | A | * | 5/1991 | Voss | 123/467 |
| 5,156,132 | A | * | 10/1992 | Iwanaga | 123/496 |
| 5,660,368 | A | * | 8/1997 | Matthaeis et al. | 251/30.02 |
| 5,862,793 | A | * | 1/1999 | Jay et al. | 123/467 |
| 5,890,471 | A | * | 4/1999 | Nishimura | 123/496 |
| 5,915,361 | A | * | 6/1999 | Heinz et al. | 123/467 |
| 6,131,540 | A | * | 10/2000 | Bronkal | 123/467 |

* cited by examiner

*Primary Examiner*—Carl S. Miller
(74) *Attorney, Agent, or Firm*—Ronald E. Greigg

(57) ABSTRACT

A fuel injection valve for high-pressure injection of fuel from a high-pressure reservoir into a combustion chamber of an internal combustion engine, especially a diesel engine, is described. The fuel injection valve has a magnet valve by means of which the fuel pressure can be either relieved (injection position) or built up (closing position) in a control chamber via a throttle having at least one throttle conduit segment defined by conduit walls. According to the invention, the throttle conduit segment is embodied substantially in the form of a variable aperture, or a variable throttle aperture.

9 Claims, 2 Drawing Sheets

Figure 1:
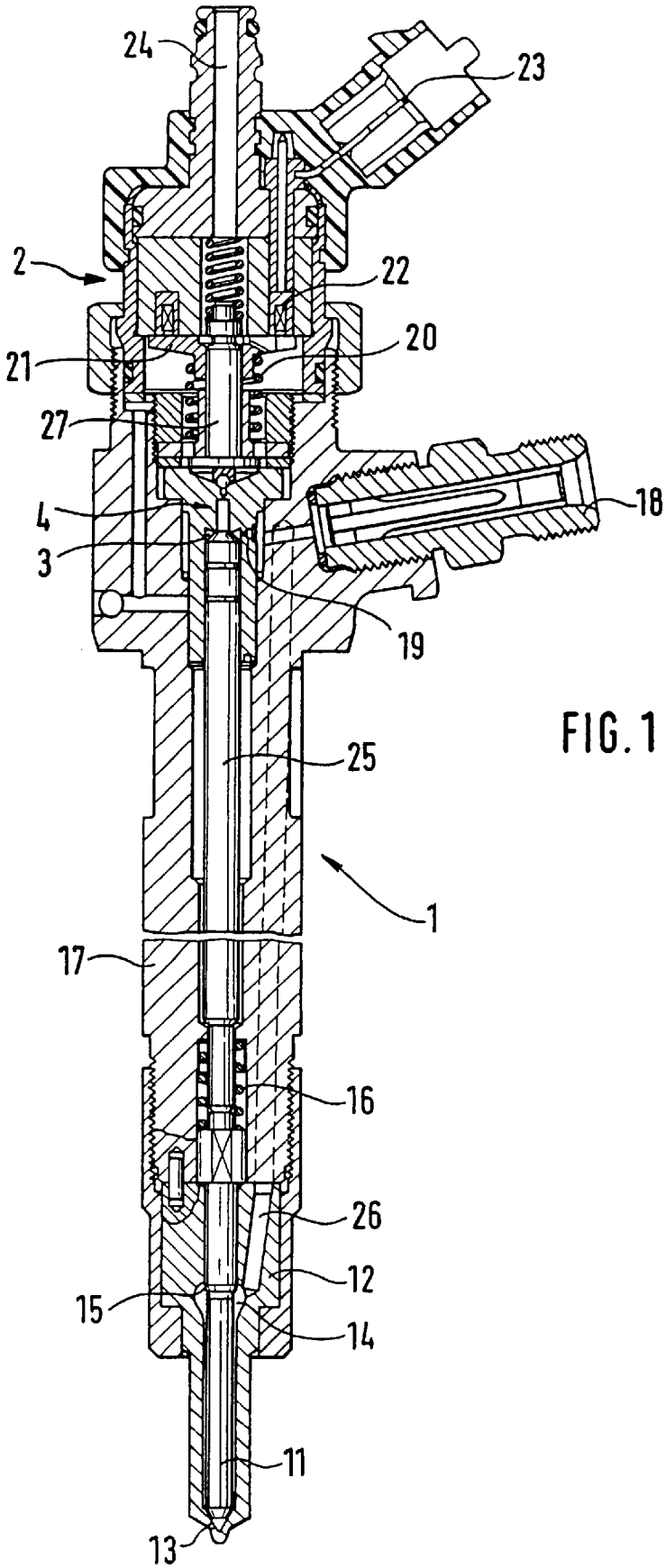

FUEL INJECTION VALVE FOR HIGH-PRESSURE INJECTION WITH IMPROVED CONTROL OF FUEL DELIVERY

Prior Art

The invention relates to a fuel injection valve for high-pressure injection of fuel from the high-pressure reservoir into a combustion chamber of an internal combustion engine as generically defined by the preamble to claim 1.

One such fuel injection valve is described in German Patent Disclosure DE 196 19 523 A1. In this known injection valve, the control of the injection is effected electrohydraulically, by delivering fuel from the high-pressure reservoir at high pressure to a control chamber. By means of this control pressure, the valve member of the fuel injection valve is then kept in the opening position. This is attained because the control surface area of the valve member acted upon by the control pressure is greater than the area acted upon of the shoulder of the nozzle needle of the fuel injection valve. The control chamber communicates permanently with the high-pressure reservoir, specifically in throttled fashion, and it can be relieved via a further throttle with a throttle conduit segment. This latter throttle is controlled by a magnet valve. As soon as the magnet valve opens this throttle, the control chamber is relieved, and as a result the pressure at the pressure faces of the valve member of the injection valve is sufficient to allow it to be put into the open position or in other words the injection position, during which the injection takes place. If this throttle is now closed again by the magnet valve, an increase of pressure occurs in the control chamber, and as a consequence the valve member is returned to the opening position. The fuel injection valve also has a relief line, leading away from the electromagnet of the magnet valve, and the fuel quantity diverted at the aforementioned throttle can flow out to a relief chamber via this line.

A similar basic layout is also described in European Patent Disclosure EP 0 661 442 A1. The throttle, which is controllable by means of the magnet valve and which seals off the side of the fuel injection valve toward the relief line or opens it and connects it with the control chamber, has two cylindrically embodied conduit portions. The first conduit portion, which represents the actual throttle conduit cross section, is relatively long compared to its diameter and discharges with an abrupt change in cross section into the second cylindrical portion, which has a considerably larger cross section and establishes the communication between the actually thin, long throttle conduit segment and the control chamber.

Especially in the case of the slender, long and thin throttle conduit segments, the flow of fuel has enough time to develop in such a way that the fuel presses against the conduit walls. With such narrow throttle conduit cross sections, however, this entails not inconsiderable flow losses. To reduce the flow losses, the course taken is to lap the conduit walls of these throttle conduit cross sections in order to reduce their roughness. This involves major technological effort, however, which means high production costs. Particularly with very narrow throttle conduit cross sections, this kind of superfine surface machining runs up against the limits of technical feasibility, taking reasonable costs into account.

The object of the invention is therefore to create a fuel injection valve whose throttle between the magnet valve and control chamber can be manufactured at little production effort or expense and with low flow losses.

This object is attained with a fuel injection valve is having the characteristics of claim 1. Expedient refinements are defined by the dependent claims.

ADVANTAGES OF THE INVENTION

The fuel injection valve according to the invention for the high-pressure injection of fuel from a high-pressure reservoir into a combustion chamber of an internal combustion engine, specifically a diesel engine, has a magnet valve by means of which the fuel pressure in a control chamber, via a throttle which has at least one throttle conduit segment with conduit walls, can be relieved, which corresponds to the injection position of the fuel injection valve, or built up, which corresponds to the opening position of the fuel injection valve, or the noninjection position. According to the invention, the throttle conduit segment is embodied substantially in the form of a variable aperture. Because the throttle conduit segment is embodied as a variable throttle aperture, an intentional influence is exerted on the development of the flow in the throttle conduit cross section, by making the actual throttle conduit segment so short that in its action it is like a variable aperture, in which when there is a flow to it, the conduit portions preceding the variable aperture and the fuel injection valves downstream of the variable aperture are substantially untouched by the flow at their conduit walls. This creates less flow resistance, on the one hand, so that the control behavior of the fuel injection valve can be improved considerably. On the other, because the throttle conduit cross section is embodied as a variable aperture, the complicated and expensive superfine surface machining in the otherwise relatively narrow flow conduit is dispensed with. As a result, the production costs can be reduced. Moreover, this reduces the influence of the precision of production on the flow behavior in such a throttle, since the flow through the immediate region of the throttle is substantially independent of the form of the surface of the remainder of the conduit.

The throttle conduit segment preferably has an l/d ratio such that cavitation occurs intentionally. Via a special geometric embodiment, especially a short length, it is also attained in this exemplary embodiment that the flow, when there is a flow through the actual throttle conduit segment, substantially does not press against its conduit walls, thus reducing the flow losses.

Preferably, the throttle conduit segment has an l/d ratio in the range from 0.1 to $\leqq 2$, in particular 1.0 to 1.5. In this connection, it can be noted that in particular in accordance with theoretical tests with l/d ratios in the range from 2 to 3, no cavitation occurs. In a practical sense, however, the cavitation does occur but is reduced. To preserve the original effect, namely to employ cavitation intentionally so that the flow will not press against the conduit wall, the length of the throttle conduit segment in proportion to its diameter is reduced considerably, thus achieving greatly reduced l/d ratios. Especially at very low l/d ratios, the throttle conduit segment assumes the form of a variable throttle aperture.

To exert a further purposeful influence on flow conditions inside the throttle, in a further preferred feature of the invention, the throttle conduit segment is embodied in a transition region with cross-sectional enlargement in the direction toward the control chamber in rounded fashion, in particular HE-rounded. Because of the rounded embodiment of the transitional region, the constriction of the fuel stream is reduced, which further reduces flow losses in the flow through the actual throttle conduit cross section or variable throttle aperture.

Preferably, the throttle has a first throttle conduit, which is closable by means of a closing element of the magnet valve, and a second throttle conduit, which discharges into the control chamber, and the variable aperture-like throttle conduit segment or variable throttle aperture is disposed between the first throttle conduit and the second throttle conduit in an approximately axial direction to one another. The diameters of the throttle conduits are embodied such that flow losses are kept relatively low, and the variable aperture like throttle conduit segment between the two throttle conduits is made so short that it takes on the form of a variable throttle aperture.

DESCRIPTION OF AN EXEMPLARY EMBODIMENT

Figure 2:
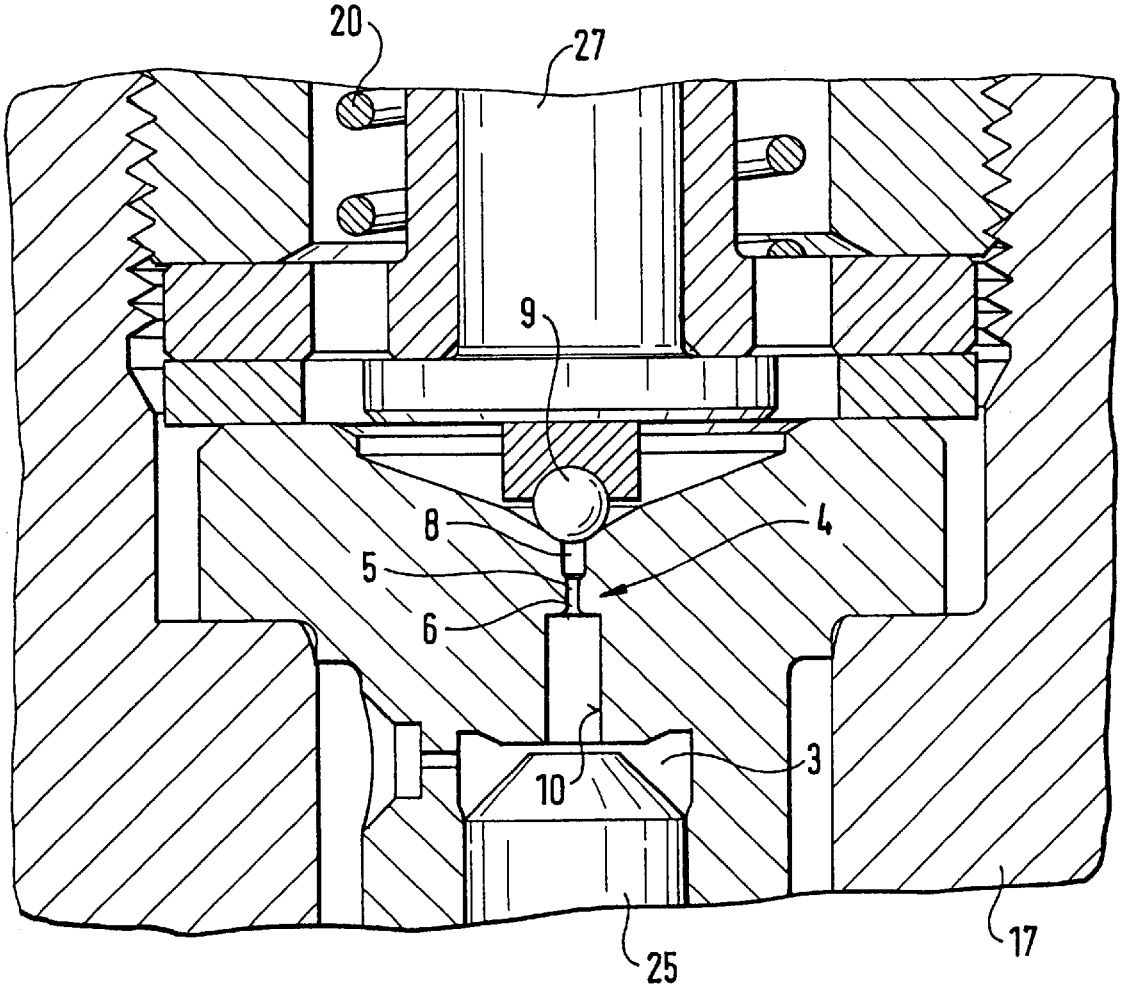

Further advantages, characteristics and possible applications of the invention will now be described in detail in terms of an example in conjunction with the accompanying drawings. Shown are:

FIG. 1, a cross-sectional view of a fuel injection valve for high-pressure injection to explain its basic functioning;

FIG. 2, an enlarged sectional view of the region of the fuel injection valve of FIG. 1, in which the throttle is disposed along with the variable aperture-like throttle conduit segment according to the invention.

In FIG. 1, a longitudinal section is shown through a fuel injection valve for high-pressure injection of fuel with a magnet valve 2 integrated with it. The valve housing 17 of the fuel injection valve includes a bore into which a nozzle needle 11 is provided, the nozzle needle having a conical sealing face known per se, which in the closing state comes into contact with a conical valve seat. Extending away from this valve seat are injection bores, which represent the actual nozzle 13 in the nozzle body 12. The nozzle needle 11 is urged in the closing position onto the valve seat by a compression spring 16. The nozzle needle 11 also has a pressure shoulder 15, in the vicinity of which a pressure chamber 14 is provided in the nozzle body 12; this chamber communicates with a high-pressure inlet line 26, by way of which fuel is delivered at high pressure, preferably a pressure of 120 MPa to the pressure chamber 14 from a high-pressure connection 18 in the form of a pressure neck. When the appropriate high pressure prevails in the pressure chamber 14, it acts on the pressure shoulder 15 and thus generates a force acting in the axial direction of the nozzle needle 11; given suitable control of the magnet valve 2, this force is sufficient to lift the nozzle needle 11 and uncover the nozzle bores of the nozzle 13 in the nozzle body 12. As a result, fuel is injected into the combustion chamber of the engine. In coaxial alignment with the compression spring 16, a valve tappet 25 also engages the nozzle needle 11; with its end face, this tappet defines a control chamber 3 in an insert part 21 in the valve housing 17 of the fuel injection valve 1. This control chamber 3, from the high-pressure connection 18, has an inlet with a high-pressure throttle 19 and an outlet to a relief line 24 that has the throttle 4 according to the invention, which is controlled by a valve member 27 of the magnet valve 2.

In a manner known per se, the magnet valve 2 has a spring 20 acting in the opening position and a magnet coil 22, which when excited attracts the valve member 27, thus opening the throttle 4. In the upper head region of the fuel injection valve 1, an electrical connection 23 is provided for supplying current to the magnet valve 2.

For the sake of clearer illustration, the region of the throttle 4 of the invention is shown again in FIG. 2 as an enlarged sectional view. The throttle 4 has a first throttle conduit 8, which is closable by means of a ball-like closing element 9 that is actuatable by the magnet valve 2; a throttle conduit segment 5, which includes a rounded transitional region 6 is embodied in the form of a variable aperture; and a second throttle conduit 10. The transition of the throttle conduit portion 5 is embodied as the rounded transitional region 6, to counteract constriction of the fuel stream. The second throttle conduit 10 discharges into the control chamber 3, in which the valve tappet 25 is located that can be acted upon by fuel pressure through suitable pressure in the control chamber 3. The magnet valve-controlled throttle 4 according to the invention is disposed inside the valve housing 17.

Because the throttle conduit segment 5 has such a short length or an l/d ratio such that it acts as a variable throttle aperture, and because the transitional region from this throttle conduit segment 5 to the second throttle conduit 10 is embodied as a rounded transitional region 6, and because the geometric relationships among the individual throttle conduits or throttle conduit segments and the radii of the rounded transitional region 6 are adapted to one another, the embodiment of the flow through the throttle can be optimized along all the conduit portions or throttle conduits with a view to optimal control of the fuel injection valve 1.

The foregoing relates to a preferred exemplary embodiments of the invention, it being understood that other variants and embodiments thereof are possible within the spirit and scope of the invention, the latter being defined by the appended claims.

What is claimed is:

1. A fuel injection valve (1) for high-pressure injection of fuel from a high-pressure reservoir into a combustion chamber of an internal combustion engine which has a magnet valve (2) by means of which the fuel pressure selectively can be either relieved in a first injection position or built up in a second closing position in a control chamber (3) via a throttle (4) having at least one throttle conduit segment (5) defined by conduit walls, and the throttle conduit segment (5) is embodied with a rounded transitional region (6) in the form of a variable aperture, and the throttle conduit segment (5) has a length to diameter (l/d) ratio chosen to cause cavitation thereof, and a geometric embodiment, in particular a length thereof, such that during a flow of fuel through said segment, the flow substantially does not press against the conduit walls.

2. The fuel injection valve (1) according to claim 1, in which the throttle conduit segment (5) has an l/d ratio in a range from 0.1 to $\leqq 2$.

3. The fuel injection valve (1) according to claim 1, in which the throttle conduit segment (5) is embodied in a transition region (6) with a cross-sectional enlargement in rounded fashion as viewed in a direction toward the control chamber.

4. The fuel injection valve (1) according to claim 2, in which the throttle conduit segment (5) is embodied in a transition region (6) with a cross-sectional enlargement in rounded fashion as viewed in a direction toward the control chamber.

5. The fuel injection valve (1) according to claim 1, in which the throttle (4) has a first throttle conduit (8), which is closable by means of a closing element (9) of the magnet valve (2), and a second throttle conduit (10), which discharges into the control chamber (3), and the throttle conduit segment (5) is disposed between the first throttle conduit (8) and the second throttle conduit (10) in an approximately axial direction to one another.

6. The fuel injection valve (1) according to claim 2, in which the throttle (4) has a first throttle conduit (8), which is closable by means of a closing element (9) of the magnet valve (2), and a second throttle conduit (10), which discharges into the control chamber (3), and the throttle conduit segment (5) is disposed between the first throttle conduit (8) and the second throttle conduit (10) in an approximately axial direction to one another.

7. The fuel injection valve (1) according to claim 3, in which the throttle (4) has a first throttle conduit (8), which is closable by means of a closing element (9) of the magnet valve (2), and a second throttle conduit (10), which discharges into the control chamber (3), and the throttle conduit segment (5) is disposed between the first throttle conduit (8) and the second throttle conduit (10) in an approximately axial direction to one another.

8. The fuel injection valve (1) according to claim 4, in which the throttle (4) has a first throttle conduit (8), which is closable by means of a closing element (9) of the magnet valve (2), and a second throttle conduit (10), which discharges into the control chamber (3), and the throttle conduit segment (5) is disposed between the first throttle conduit (8) and the second throttle conduit (10) in an approximately axial direction to one another.

9. The fuel injection valve (1) according to claim 1, in which the throttle conduit segment (5) has an l/d ratio in a range from 1.0 to 1.5.

* * * * *